US008215782B2

(12) United States Patent
Yang

(10) Patent No.: US 8,215,782 B2
(45) Date of Patent: Jul. 10, 2012

(54) MOVING HEAD LIGHT

(75) Inventor: Jung Hsiang Yang, Shenzhen (CN)

(73) Assignee: IAG Group Limited, Shenzhen (CN)

( * ) Notice: Subject to any disclaimer, the term of this patent is extended or adjusted under 35 U.S.C. 154(b) by 113 days.

(21) Appl. No.: 12/885,960

(22) Filed: Sep. 20, 2010

(65) Prior Publication Data

US 2011/0292637 A1 Dec. 1, 2011

(30) Foreign Application Priority Data

May 27, 2010 (CN) ..... 2010 1 0190102

(51) Int. Cl.
*F21V 33/00* (2006.01)

(52) U.S. Cl. ..... 362/35

(58) Field of Classification Search ..... 362/35
See application file for complete search history.

(56) References Cited

U.S. PATENT DOCUMENTS 2,947,970 A * 8/1960 Van Oosten ..... 362/35
5,951,139 A * 9/1999 Smith et al. ..... 362/33
6,705,745 B1 * 3/2004 Pederson ..... 362/284
7,033,036 B2 * 4/2006 Pederson ..... 362/35
2002/0041499 A1 * 4/2002 Pederson ..... 362/545
2007/0263376 A1 * 11/2007 Wilkinson et al. ..... 362/35
2009/0091914 A1 * 4/2009 Nobayashi ..... 362/35

OTHER PUBLICATIONS

Co-pending U.S. Appl. No. 12/879,456, filed Sep. 10, 2010.

* cited by examiner

*Primary Examiner* — Laura Tso
(74) *Attorney, Agent, or Firm* — Hamre, Schumann, Mueller & Larson, P.C.

(57) ABSTRACT

The present invention discloses a moving head light included a light source group having a plurality of light sources, a reflector group slantwise arranged at a circumference of the light source group, and a rotary drive device for driving the reflector group to rotate relative to the light source group. Each reflector corresponds to each light source one by one, and the reflector group includes a plurality of reflectors. The reflectors are rotated around the light sources, so that the lights sent out from the light sources are projected to the space after being reflected by the reflectors, and the faculae are divided into two from one and jointed into one from two. Accordingly, the stage rendering effect is better and a sort of fantasy feel is produced for persons.

10 Claims, 3 Drawing Sheets

MOVING HEAD LIGHT

TECHNICAL FIELD

The present invention relates to stage light equipments, and more particularly, to a moving head light.

BACKGROUND

The moving head light are widely used, and is capable of using for performance centers, professional stages, bars, multifunctional halls and exhibition halls, etc. The conventional moving head light only has the simple functions of movable lighting and environment dyeing, so that the stage rendering effect is not good.

SUMMARY

The present invention aims at providing the moving head light to solve the problem that the stage rendering effect of the conventional moving head light is not good.

The present invention are carried out as follows: a moving head light includes a light source group having a plurality of light sources, a reflector group which is slantwise arranged at the circumference of the light source group, and a rotary drive device for driving the reflector group to rotate relative to the light source group; the reflector group includes a plurality of reflectors, and each reflector corresponds to each light source one by one.

The present invention uses the rotary drive device to adjust the relative angles between the reflectors and the light sources, so that lights sent out from the light sources generate a special effect of scaling in the space after being reflected by the reflectors, therefore, the stage rendering effect is good to make persons feel mystery and fantasy.

DETAILED DESCRIPTION OF THE PREFERRED EMBODIMENTS

Objects, advantages and embodiments of the present invention will be explained below in detail with reference to the accompanying drawings. However, it is to be appreciated that the following description of the embodiment(s) is merely exemplary in nature and is no way intended to limit the invention, its application, or uses.

The moving head light in accordance with the present invention includes a light source group having a plurality of light sources, a reflector group which is slantwise arranged at a circumference of the light source group, and a rotary drive device for driving the reflector group to rotate relative to the light source group; and the reflector group includes a plurality of reflectors, and each reflector corresponds to each light source one by one.

The relative angles between the reflectors and the light sources are adjusted when the rotary drive device drives the reflector group to rotate relative to the light source group, so that lights sent out from the light sources generate a special effect of scaling in the space after being reflected by the reflectors, therefore, the stage rendering effect is good.

The embodiments of the invention are further described by taking the LEDs as the light sources.

Embodiment 1

Figure 1:
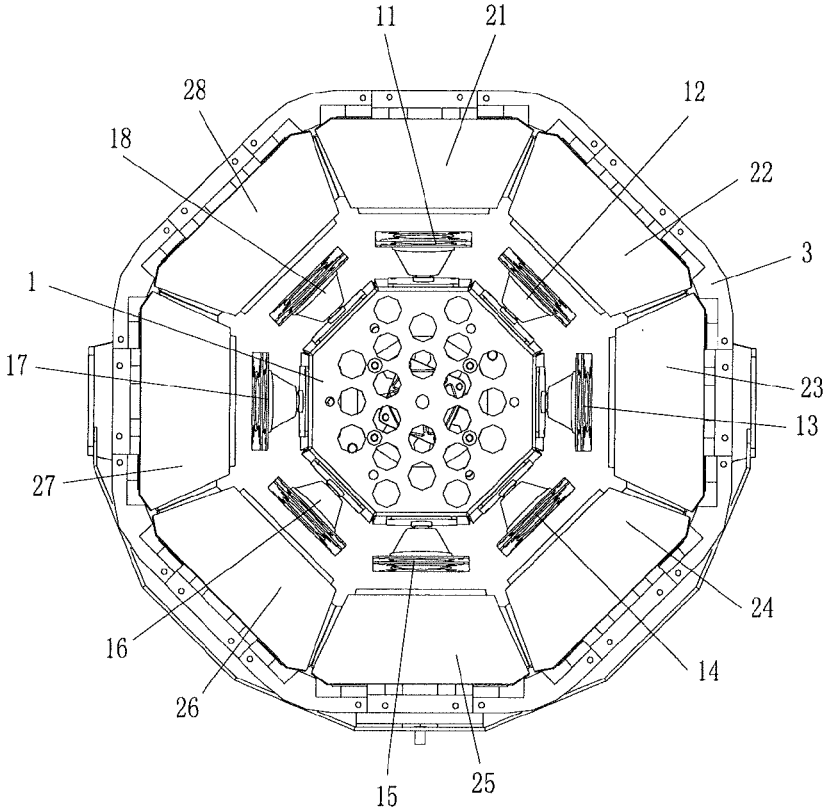
FIG. 1 is a top view of a moving head light in accordance with the present invention (when eight faculae are produced)
Figure 2:
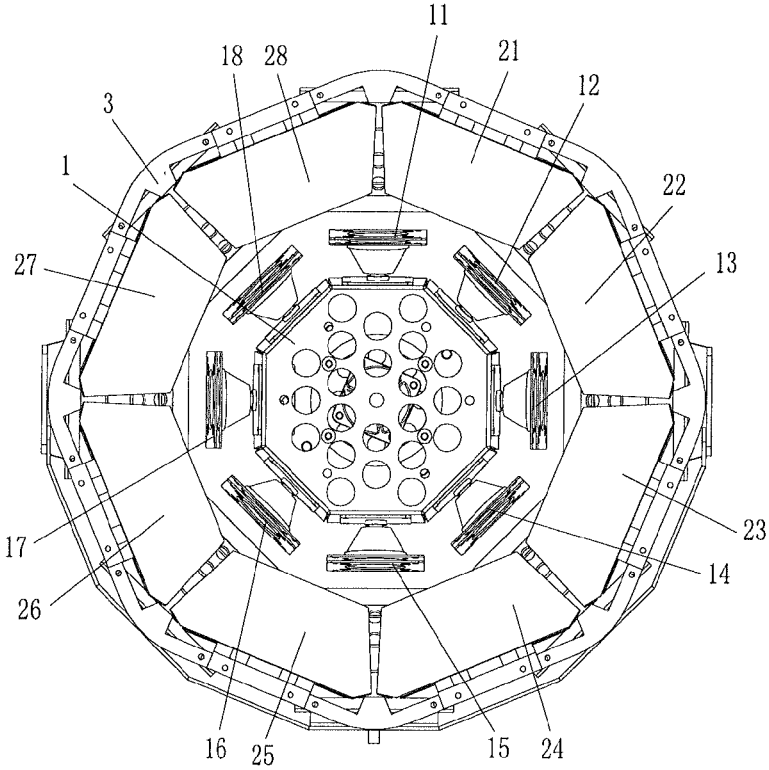
FIG. 2 is a top view of the moving head light in accordance with the present invention (when sixteen faculae are produced)
Figure 3:
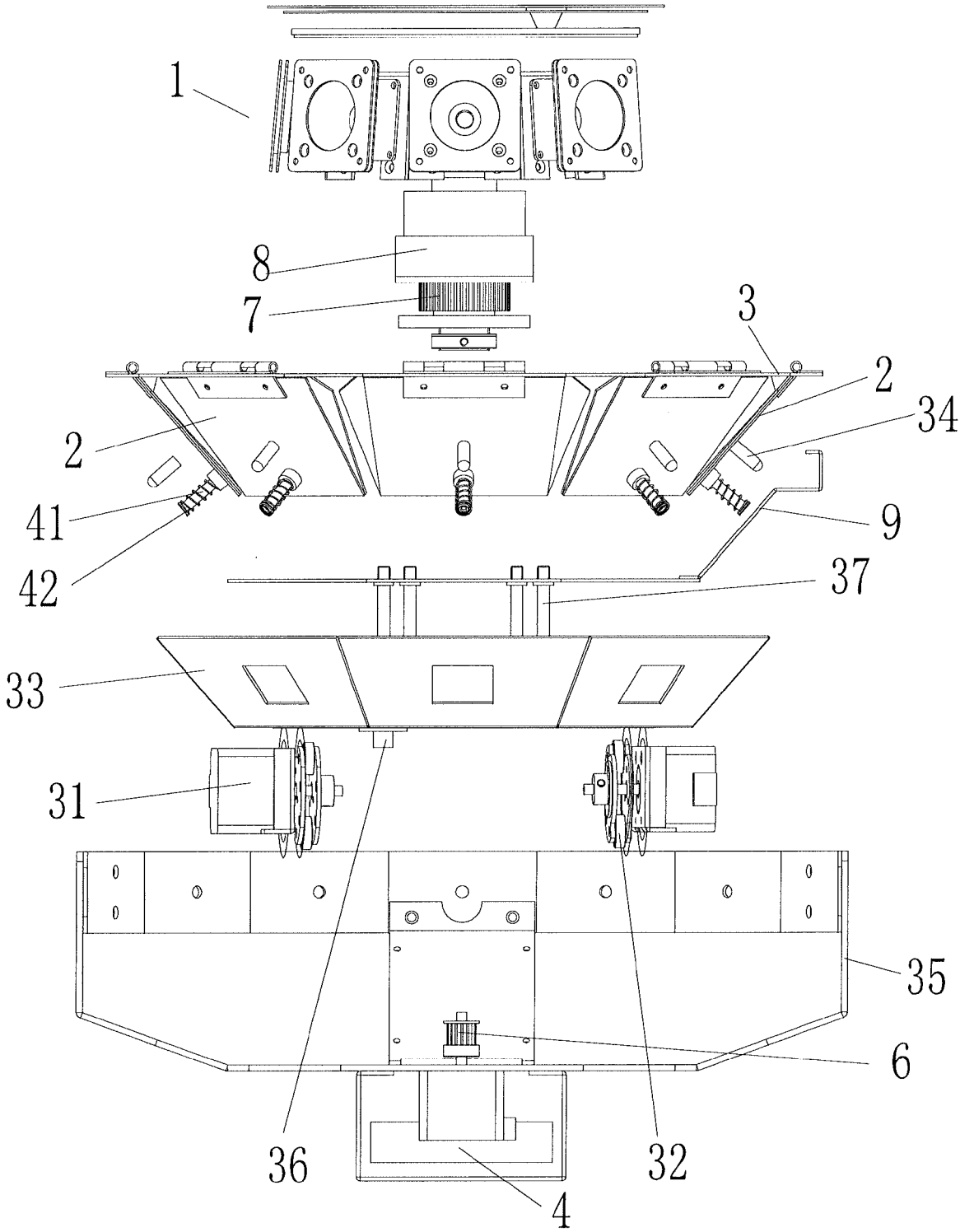
FIG. 3 is an exploded view of the moving head light in accordance with the present invention.

Referring to FIGS. 1-3, the moving head light in accordance with the invention includes the light source group having eight LEDs. In detail, the light source group includes: a first LED11, a second LED12, a third LED13, a forth LED14, a fifth LED15, a sixth LED16, a seventh LED17 and an eighth LED18; and each LED is arranged at each side of a light head 1.

Correspondingly, the moving head light includes the reflector group including eight reflectors. In detail, the reflector group includes a first reflector 21, a second reflector 22, a third reflector 23, a forth reflector 24, a fifth reflector 25, a sixth reflector 26, a seventh reflector 27 and an eighth reflector 28. Each reflector is mounted to each corresponding side plates 2 of a rotation bracket 3.

Preferably, the light sources are white light LEDs with the luminous angles of 100-140 degrees and the power of 10 W. The included angles between the optic axis of the LEDs and the reflectors are 30-60 degrees.

The rotation bracket 3 is a octagon frustum pyramid in shape. The light head is disposed on a central portion of the rotation bracket 3. The rotation bracket 3 is rotated by the rotary drive device to cause the reflector group to rotate relative to the light source group.

The rotary drive device includes a rotary drive motor 4, a first gear 6 driven by the rotary drive motor 4, a second gear 7 engaged with the first gear 6, and a shaft sleeve 8 fixedly connected with the second gear 7, a fixed bracket 9 extended through the shaft sleeve 8, and the rotation bracket 3 integrally assembled with the fixed bracket 9. The first gear 6 is connected with the second gear 7 via a belt.

When the rotation bracket 3 is rotated to the position as showed in the FIG. 1, the lights sent out from each LED are reflected via each reflector to be formed to have a facula. If all the LEDs are lightened, the eight faculae are generated in a space.

When the rotation bracket 3 is rotated to the position as showed in the FIG. 2, the lights sent out from the LEDs generate two faculae after being reflected by two adjoining reflectors as the LEDs have a certain luminous angle. If all the LEDs are lightened, the sixteen faculae are generated in the space.

According to live music rhythm and performance atmosphere, the rotation velocity of the rotation bracket 3 is adjusted to thereby change the number of the faculae. Accordingly, the stage rendering effect is better and a sort of fantasy feel is produced for persons.

The relative position between each reflector and each light source is changed when the rotation bracket 3 is rotated from the position as shown in FIG. 1 to the position as shown in FIG. 2, so that the location of the faculae is changed, thereby providing a sort of dynamic feeling for persons.

In the embodiment, the reflectors are rotated around the light sources, so that the lights sent out from the light sources are projected to the space after being reflected by the reflectors, and the faculae are divided into two from one and jointed into one from two, therefore, the stage rendering effect is better.

Embodiment 2

The second embodiment of the invention is additionally provided with a angle-adjusting device on the basis of the moving head light in accordance with the first embodiment of the invention. The relative angle between each reflector and each corresponding light source is adjusted by using the angle-adjusting device in the embodiment of the present invention, so that lights sent out from the light sources generate a special effect of scaling in the space after being reflected by the reflector, therefore, the stage rendering effect is good.

Figure 4:
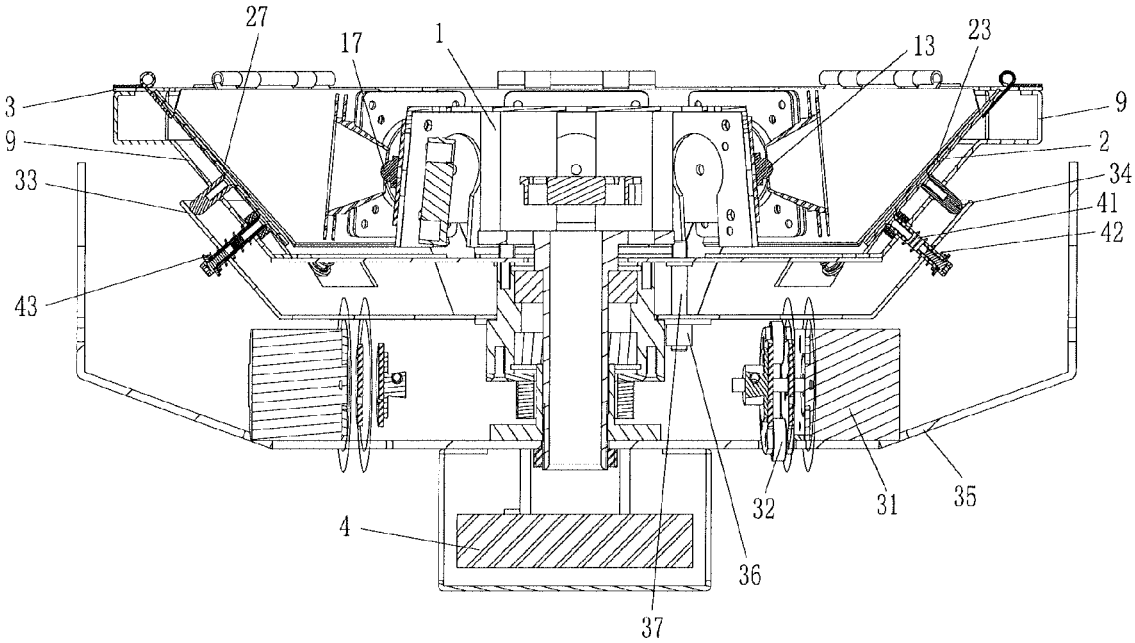
FIG. 4 is a sectional view of the moving head light in accordance with the present invention (when the faculae are shrunk)
Figure 5:
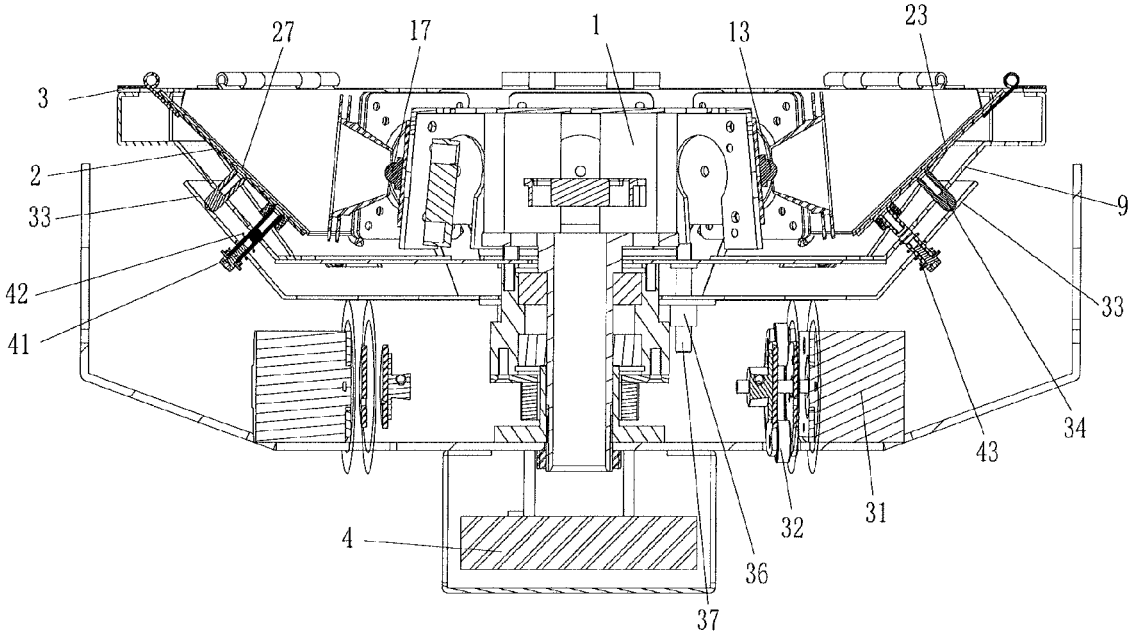
FIG. 5 is a sectional view of the moving head light in accordance with the present invention (when the faculae are opened).

Referring to FIGS. 3-5, each side plate 2 is movable. An upper end of the side plate 2 is positioned, and a lower end of the side plate 2 can be rotated under the action of external force. The angle-adjusting devices are respectively arranged at a rear side of each of the side plate 2, and the angle-adjusting device includes an angle-pushing mechanism and an angle-resetting mechanism therein.

In detail, the angle-pushing mechanism includes an angle-driving motor 31 which is fixedly arranged at a radial direction of a main bracket 35, a cam 32 driven by the angle-driving motor 31, an angle-pushing bracket 33 movably connected with the cam 32, a push rod 34 disposed on the rear side of each movable side plate 2 and abutted against the angle-pushing bracket 33. The cam 32 may be a bearing cam, and the frictional force between the angle-pushing bracket 33 and the bearing cam is smaller when the angle-pushing bracket 33 is rotated. The angle-pushing bracket 33 is a octagon frustum pyramid in shape, and disposed on an external side of the shaft sleeve 8. A bottom portion of the angle-pushing bracket 33 is provided with a plurality of guiding sleeves 36, correspondingly, and the fixed bracket 9 is provided with a plurality of guiding columns 37 which are matched with the guiding sleeves 36. The push rod 34 is extended through the fixed bracket 9 to be movably abutted against the angle-pushing bracket 33.

In the embodiment, the angle-resetting mechanism is an elastic resetting mechanism which includes a spring column 41 and a resetting spring 42 arranged at a periphery of the spring column 41. The spring column 41 is extended through sidewalls of the fixed bracket 9 and the angle-pushing bracket 33. One end of the resetting spring 42 is limited by a stopping sheet 43 disposed at a distal end of the spring column 41, and the other end thereof is abutted against the rear side of the fixed bracket 9.

After starting the angle-driving motor 31, the cam 32 is rotated from a low position to a high position to drive the angle-pushing bracket 33 to lift up along a guiding column 37; the angle-pushing bracket 33 exerts force to the push rod 34, so that the side plate 2 of the angle-adjusting bracket 3 is upwards deflected, and the reflectors are upwards deflected simultaneously, at the moment, the fixed bracket 9 presses the resetting spring 32, and the upward deflected angles of the reflectors are 5-10 degrees. The cam 32 is rotated from the high position to the low position, the angle-pushing bracket 33 falls to the original position under the action of self-gravitation, the force exerted to the push rod 34 is disappeared, and the side plates 2 of the angle-adjusting bracket 3 are reset to the original position under the action of the resetting spring 42.

According to live music and atmosphere, the relative angle between each reflector and each light source is changed when the number of the faculae is changed, so that the lights sent out from the light sources generate a special effect of scaling in the space after being reflected by the reflectors, consequently, the stage rendering effect is better.

Referring to the FIG. 4, the side plates 2 are positioned at the original position, the lights sent out from the LEDs are reflected through the reflectors, and distances among faculae are nearer, so that the faculae are under the status of shrinkage to be like a flower bud.

When the reflector are deflected to the position of the FIG. 5, the lights sent out from the LEDs are reflected through the reflectors, and distances among faculae are further, so that the faculae are under the status of opening to be like a blooming flower.

In the embodiments, the reflectors are rotated around the light sources, so that the lights sent out from the light sources are projected to the space after being reflected by the reflectors, and the faculae are divided into two from one and jointed into one from two, therefore, the stage rendering effect is better. Simultaneously, the of the invention uses the angle-adjusting device to adjust the relative angles between the reflectors and the light sources, so that the lights sent out from the light sources generate a special effect of scaling in the space after being reflected by the reflectors, therefore, the stage rendering effect is good. In addition, according to live music rhythm and performance atmosphere, when the rotation velocity of the reflectors is adjusted, the velocity of the relative angle between the reflectors and the light sources is changed to thereby change the number and location of the faculae. Accordingly, a sort of fantasy feel is produced for persons.

The present invention may be embodied in other forms without departing from the spirit or novel characteristics thereof. The embodiment disclosed in this application is to be considered in all respects as illustrative and not limitative. The scope of the invention is indicated by the appended claims rather than by the foregoing description; and all changes which come within the meaning and range of equivalency of the claims are intended to be embraced therein.

What is claimed is:

1. A moving head light comprising:

a light source group having a plurality of light sources;

a reflector group slantwise arranged at a circumference of the light source group, and the reflector group having a plurality of reflectors; and a rotary drive device for driving the reflector group to rotate relative to the light source group, wherein each reflector corresponds to each light source one by one.

2. The moving head light as claimed in claim 1, wherein the rotary drive device comprises the rotary drive motor, a first gear driven by the rotary drive motor, a second gear engaged with the first gear, a shaft sleeve fixedly connected with the second gear, a fixed bracket extended through the shaft sleeve, and a rotation bracket integrally assembled with the fixed bracket.

3. The moving head light as claimed in claim 2, wherein the rotation bracket is formed to have a plurality of side plate for mounting the reflectors thereon.

4. The moving head light as claimed in claim 3, wherein each side plate is movable, and an upper end of the side plate is positioned, and a lower end of the side plate can be rotated under the action of external force.

5. The moving head light as claimed in claim 4, wherein an angle-adjusting device is arranged at a rear side of each of the side plate, and the angle-adjusting device comprises an angle-pushing mechanism and an angle-resetting mechanism therein.

6. The moving head light as claimed in claim 5, wherein the angle-pushing mechanism comprises an angle-driving motor, a cam driven by the angle-driving motor, an angle-pushing bracket movably connected with the cam, a push rod disposed on the rear side of each movable side plate, and the push rod is extended through the fixed bracket to be movably abutted against the angle-pushing bracket.

7. The moving head light as claimed in claim 6, wherein the angle-resetting mechanism is an elastic resetting mechanism comprising a spring column extended through the fixed bracket and a resetting spring arranged at a periphery of the spring column; and one end of the resetting spring is positioned at a distal end of the spring column, and the other end thereof is abutted against the fixed bracket.

8. The moving head light as claimed in claim 6, wherein a bottom portion of the angle-pushing bracket is provided with a plurality of guiding sleeves, and the fixed bracket is provided with a plurality of guiding columns matched with the guiding sleeves.

9. The moving head light as claimed in claim 1, wherein the light source is an LED, and the luminous angle of the LED is 100-140 degrees.

10. The moving head light as claimed in claim 9, wherein an included angle between the optic axis of the LED and the reflector is 30-60 degrees.

* * * * *